US006457713B1

(12) United States Patent
Oppenheimer et al.

(10) Patent No.: US 6,457,713 B1
(45) Date of Patent: Oct. 1, 2002

(54) GOLF SIMULATION GAME APPARATUS

(76) Inventors: Carlos Miguel Oppenheimer, Gaspar Campos 1725, (1638) Vicente Lopez, Buenos Aires (AR); Pablo Franco Oliaro, J.E. Uriburu 634, 8° D, (1072) Capital Federal, Buenos Aires (AR)

( * ) Notice: Subject to any disclaimer, the term of this patent is extended or adjusted under 35 U.S.C. 154(b) by 64 days.

(21) Appl. No.: 09/696,838

(22) Filed: Oct. 26, 2000

(51) Int. Cl.[7] ..... A63F 3/00
(52) U.S. Cl. ..... 273/245
(58) Field of Search ..... 273/108.2, 108.21, 273/108.22, 245, 244, 259, 277

(56) References Cited

U.S. PATENT DOCUMENTS

| | | | | | |
|---|---|---|---|---|---|
| 2,157,172 | A | * | 5/1939 | Hays | 273/145 A |
| 3,130,973 | A | * | 4/1964 | Zapolski | 273/147 |
| 3,260,526 | A | * | 7/1966 | Seitz | 273/245 |
| 3,892,405 | A | | 7/1975 | Trevino | 273/87.2 |
| 3,944,229 | A | * | 3/1976 | Feeney | 273/245 |
| 3,989,249 | A | * | 11/1976 | Breslow | 273/245 |
| 4,093,233 | A | | 6/1978 | Barbarow | 273/176 A |
| 4,134,590 | A | * | 1/1979 | Conrad | 273/240 |
| 5,000,460 | A | | 3/1991 | Barbiaux et al. | 273/245 |
| 5,234,218 | A | | 8/1993 | LaRocca | 273/245 |
| 5,470,077 | A | | 11/1995 | Brewster et al. | 273/245 |
| 6,047,967 | A | | 4/2000 | Murphy et al. | 273/245 |

* cited by examiner

*Primary Examiner*—Paul T. Sewell
*Assistant Examiner*—Alvin A. Hunter
(74) *Attorney, Agent, or Firm*—Marshall, Gerstein & Borun

(57) ABSTRACT

The invention provides a golf simulation game apparatus and methods for playing the same, wherein strategic decisions, in addition to the activation of a chance means, affect the outcome of a simulated golf shot. More particularly, the invention provides a golf simulation game apparatus having a set of hole cards, each hole card having a plurality of different result zones, and each result zone corresponding to a possible outcome corresponding to a simulated golf ball location after a player's simulated shot, a set of stroke cards, each stroke card corresponding to a particular result zone of an individual golf hole and having a plurality of different sets of outcomes for any given simulated golf shot, and a chance means for determining which outcome of the plurality of different sets of outcomes is obtained after the player's simulated golf shot.

15 Claims, 7 Drawing Sheets

| | Tr | Ro2 | Ro3 |
|---|---|---|---|
| 1 | LB | LB | LB |
| 2 | LB | LB | LB |
| 3 | LB | LB | Ro3 |
| 4 | Fa1 | Ro2 | - |
| 5 | Fa1 | - | - |
| 6 | - | - | - |

| | W |
|---|---|
| S | Ro1 |
| Fa1 | Ro1 |
| Tr | Ro1 |
| Ro2 | Fa3 |
| Bu1 | Fa3 |
| | |
| | |

FIG. 2A

| S | | Par | 4 | HOLE | | | 1 | Hcp | | S | |
|---|---|---|---|---|---|---|---|---|---|---|---|
| 7/6 | 5 | 4 | 3 | 2 | 1 | L | 8 | 9 | 10 | 11 | 12 |
| Ob | Ob | Tr* | Tr | Ro2 | Ro2 | 1 | Fa3 | Ro1 | Fa3 | Fa3 | Fa3 |
| Ob | W | W | Tr* | Tr | Ro2 | 2 | Fa2 | Fa3 | Ro1 | Fa3 | Fa3 |
| W | W | Tr* | Fa1 | Fa1 | Fa1 | 3 | Fa1 | Fa2 | Fa3 | Ro1 | Fa3 |
| W | Tr* | Fa1 | Fa1 | Fa1 | Fa1 | 4 | Fa1 | Fa1 | Fa2 | Fa3 | Ro1 |

62

| Fa1 | | Par | 4 | HOLE | | | 1 | Hcp | | Fa1 | |
|---|---|---|---|---|---|---|---|---|---|---|---|
| 7/6 | 5 | 4 | 3 | 2 | 1 | L | 8 | 9 | 10 | 11 | 12 |
| W | W | W | Bu2 | Bu2 | Fa3 | 1 | Fa3 | Fa3 | Gr1 | Gr2 | Pl |
| Tr* | Tr* | Ro1* | Ro1 | Ro2 | Fa2 | 2 | Fa3 | Fa3 | Fa3 | Gr1 | Gr2 |
| W | Ro1* | Ro1* | Ro2 | Fa2 | Fa2 | 3 | Fa3 | Fa3 | Fa3 | Fa3 | Gr1 |
| Ro1* | Ro2 | Ro2 | Fa2 | Fa2 | Fa2 | 4 | Fa2 | Fa2 | Fa3 | Fa3 | Fa3 |

64

| Fa2 | | Par | 4 | HOLE | | | 1 | Hcp | | Fa1 | |
|---|---|---|---|---|---|---|---|---|---|---|---|
| 7/6 | 5 | 4 | 3 | 2 | 1 | L | 8 | 9 | 10 | 11 | 12 |
| Ro2* | Ro2* | Bu1 | Bu1 | Ro2 | Ro3 | 1 | Gr1 | Gr2 | Pl | Ps | Ps |
| Bu1 | Bu1 | Bu1 | Bu2 | Bu2 | Bu2 | 2 | Fa3 | Gr1 | Gr2 | Pl | Ps |
| Bu1 | Bu1 | Bu2 | Bu2 | Fa3 | Fa3 | 3 | Fa3 | Fa3 | Gr1 | Gr2 | Pl |
| Ro2* | Ro2* | Fa3 | Fa3 | Fa3 | Fa3 | 4 | Fa3 | Fa3 | Fa3 | Gr1 | Gr2 |

| Fa3 | | Par | 4 | HOLE | | | 1 | Hcp | | Fa2 | |
|---|---|---|---|---|---|---|---|---|---|---|---|
| 7/6 | 5 | 4 | 3 | 2 | 1 | L | 8 | 9 | 10 | 11 | 12 |
| Bu1 | Bu1 | Bu2 | Bu2 | Ro3 | Ro3 | 1 | Pl | Pl | Ps | Ps | H |
| Bu1 | Bu2 | Ro3 | Ro3 | Ro3 | Gr2 | 2 | Gr2 | Pl | Pl | Ps | Ps |
| Bu2 | Bu2 | Bu2 | Ro3 | Gr2 | Gr2 | 3 | Gr2 | Gr2 | Pl | Pl | Ps |
| Bu1 | Bu1 | Gr1 | Gr1 | Gr1 | Gr1 | 4 | Gr1 | Gr2 | Gr2 | Pl | Pl |

60

FIG. 2B

| Ro1 | | Par | 4 | HOLE | | | 1 | Hcp | | Ro1 | |
|---|---|---|---|---|---|---|---|---|---|---|---|
| 7/6 | 5 | 4 | 3 | 2 | 1 | L | 8 | 9 | 10 | 11 | 12 |
| Ro1 | Ro1 | Bu2 | Bu2 | Ro3* | Ro3 | 1 | Bu2 | Gr1 | Gr1 | Ro3 | Gr2 |
| Ro1 | Bu1 | Bu1 | Ro3* | Ro3* | Fa3 | 2 | Fa3 | Bu2 | Gr1 | Gr1 | Ro3 |
| Ro1 | Ro2 | Ro2* | Ro2 | Bu1 | Bu1 | 3 | Fa3 | Fa3 | Bu1 | Gr1 | Gr1 |
| Ro1 | Ro1 | Ro1 | Bu1 | Bu1 | Fa3 | 4 | Fa3 | Fa3 | Fa3 | Bu1 | Gr1 |

| Ro2 | | Par | 4 | HOLE | | | 1 | Hcp | | Ro2 | |
|---|---|---|---|---|---|---|---|---|---|---|---|
| 7/6 | 5 | 4 | 3 | 2 | 1 | L | 8 | 9 | 10 | 11 | 12 |
| W | W | Bu1 | Bu1 | Bu2 | Bu2 | 1 | Bu2 | Gr2 | Ro3 | Pl | Ps |
| Bu1 | Bu1 | Bu1 | Fa3 | Fa3 | Gr1 | 2 | Gr1 | Bu2 | Gr2 | Ro3 | Pl |
| Ro2 | Ro2 | Bu1 | Bu1 | Bu2 | Fa3 | 3 | Fa3 | Gr1 | Bu2 | Gr2 | Ro3 |
| Ro2 | Bu1 | Bu2 | Bu2 | Fa3 | Fa3 | 4 | Fa3 | Fa3 | Gr1 | Bu2 | Gr2 |

| Ro3 | | Par | 4 | HOLE | | | 1 | Hcp | | Ro3 | |
|---|---|---|---|---|---|---|---|---|---|---|---|
| 7/6 | 5 | 4 | 3 | 2 | 1 | L | 8 | 9 | 10 | 11 | 12 |
| W | W | Ro3* | Ro3* | Gr2 | Gr2 | 1 | Ps | Ro3 | Bu2 | Ps | H |
| W | Bu1 | Bu1 | Ro3* | Ro3* | Gr2 | 2 | Gr2 | Pl | Fa3 | Ps | Ps |
| Ro3 | Bu2 | Bu2 | Bu2 | Gr1 | Gr1 | 3 | Gr1 | Gr2 | Pl | Fa3 | Ps |
| Ro3 | Ro3 | Gr1 | Gr1 | Gr1 | Gr1 | 4 | Gr1 | Gr1 | Gr2 | Pl | Fa3 |

| Bu1 | | Par | 4 | HOLE | | | 1 | Hcp | | Bu1 | |
|---|---|---|---|---|---|---|---|---|---|---|---|
| 7/6 | 5 | 4 | 3 | 2 | 1 | L | 8 | 9 | 10 | 11 | 12 |
| W | W | Ro3* | Ro3* | Gr2 | Gr2 | 1 | Pl | Ro3 | Bu2 | Ps | H |
| W | Bu1 | Bu1 | Ro3* | Ro3* | Gr2 | 2 | Bu2 | Pl | Ro3 | Bu2 | Ps |
| Bu1 | Bu1 | Fa3 | Fa3 | Gr2 | Gr2 | 3 | Gr2 | Bu2 | Pl | Ro3 | Bu2 |
| Fa3 | Fa3 | Fa3 | Gr1 | Gr1 | Gr1 | 4 | Gr1 | Gr2 | Bu2 | Pl | Ro3 |

70

| Bu2 | | Par | 4 | HOLE | | | 1 | Hcp | | Bu2 | |
|---|---|---|---|---|---|---|---|---|---|---|---|
| 7/6 | 5 | 4 | 3 | 2 | 1 | L | 8 | 9 | 10 | 11 | 12 |
| Bu1 | Ro3 | Ro3 | Ro3 | Gr1 | Gr1 | 1 | Ps | Ro3 | Ps | Ro3 | H |
| Bu1 | Bu1 | Bu1 | Ro3 | Ro3 | Ro3 | 2 | Pl | Ps | Ro3 | Ps | Ro3 |
| Bu1 | Bu2 | Bu2 | Ro3 | Ro3 | Gr1 | 3 | Gr2 | Pl | Ps | Ro3 | Ps |
| Bu2 | Bu2 | Bu2 | Gr1 | Gr1 | Gr1 | 4 | Gr1 | Gr2 | Pl | Ps | Ro3 |

| Tr | | Par | 4 | HOLE | | | 1 | Hcp | | Tr | |
|---|---|---|---|---|---|---|---|---|---|---|---|
| 7/6 | 5 | 4 | 3 | 2 | 1 | L | 8 | 9 | 10 | 11 | 12 |
| Ob | Ob | Tr* | Tr* | Bu2 | Bu2 | 1 | Bu1 | Fa3 | Ro2 | Fa3 | Fa3 |
| Ob | Tr* | Ro2 | Ro2 | Ro2 | Bu2 | 2 | Fa2 | Bu1 | Fa3 | Ro2 | Fa3 |
| W | W | Tr* | Tr* | Ro1 | Ro1 | 3 | Fa2 | Fa2 | Ro1 | Fa3 | Ro2 |
| W | Tr* | Tr* | Ro1 | Ro1 | Ro1 | 4 | Ro1 | Fa2 | Fa2 | Ro1 | Fa3 |

60

GREEN CARD 66

| | | | | | | | | | | | |
|---|---|---|---|---|---|---|---|---|---|---|---|
| | Gr1 | | Par | 4 | HOLE | | 1 | | Hcp | | Gr1 |
| | 2 | 3 | 4 | 5 | 6 | 7 | 8 | 9 | 10 | 11 | 12 |
| 94 → | Pl | Gi | Pl | Pl | Ps | H | Ps | Pl | Pl | Gi | Pl |
| 96 → | Pl | Pl | Pl | Pl | Pl | Ps | Ps | Ps | Gi | H | H |
| 98 → | H | H | Ps | Pl | Pl | Pl | Pl | Pl | Ps | H | H |

| | | | | | | | | | | | |
|---|---|---|---|---|---|---|---|---|---|---|---|
| | Gr2 | | Par | 4 | HOLE | | 1 | | Hcp | | Gr2 |
| | 2 | 3 | 4 | 5 | 6 | 7 | 8 | 9 | 10 | 11 | 12 |
| | H | H | Ps | Ps | Pl | H | Pl | Ps | Ps | H | H |
| | Pl | Pl | Pl | Pl | Ps | Ps | Ps | Ps | H | H | H |
| | Pl | Pl | Pl | Pl | Pl | Pl | Gi | Hcp | H | H | H |

68

| | | | | | | | | | | | |
|---|---|---|---|---|---|---|---|---|---|---|---|
| | Pl | | Par | 4 | HOLE | | 1 | | Hcp | | Pl |
| | 2 | 3 | 4 | 5 | 6 | 7 | 8 | 9 | 10 | 11 | 12 |
| | Pl | H | Ps | Ps | H | H | H | Ps | Ps | H | Pl |
| | Pl | Pl | Ps | Ps | Ps | Gi | H | H | H | H | H |
| | Pl | Ps | Gi | H | H | H | H | H | Gi | Ps | Pl |

67

| | | | | | | | | | | | |
|---|---|---|---|---|---|---|---|---|---|---|---|
| | Ps | | Par | 4 | HOLE | | 1 | | Hcp | | Ps |
| | 2 | 3 | 4 | 5 | 6 | 7 | 8 | 9 | 10 | 11 | 12 |
| | Ps | H | Gi | H | H | H | H | H | Gi | H | Ps |
| | Pl | Ps | Gi | Gi | H | H | H | H | H | H | H |
| | Gi | Gi | Gi | H | H | H | H | H | Gi | Gi | Gi |

69

65

FIG. 3

| | Bu1 | | Par 4 | | HOLE 1 | | | Hcp | | Bu1 | | |
|---|---|---|---|---|---|---|---|---|---|---|---|---|
| 72 | 7/6 | 5 | 4 | 3 | 2 | 1 | L | 8 | 9 | 10 | 11 | 12 |
| 74 | W | W | Ro3* | Ro3* | Gr2 | Gr2 | 1 | Pl | Ro3 | Bu2 | Ps | H |
| 76 | W | Bu1 | Bu1 | Ro3* | Ro3* | Gr2 | 2 | Bu2 | Pl | Ro3 | Bu2 | Ps |
| 78 | Bu1 | Bu1 | Fa3 | Fa3 | Gr2 | Gr2 | 3 | Gr2 | Bu2 | Pl | Ro3 | Bu2 |
| 80 | Fa3 | Fa3 | Fa3 | Gr1 | Gr1 | Gr1 | 4 | Gr1 | Gr2 | Bu2 | Pl | Ro3 |

86 82 84 70

FIG. 4

| | | A | Tr1 | Ro1 | Ro2 | Tr2 | Bu1 | Fa1 | Tr3 | Fa2 | Bu2 | Fa3 | Bu3 | Fa4 | Gr | Pl | Ps | Gi | H |
|---|---|---|---|---|---|---|---|---|---|---|---|---|---|---|---|---|---|---|---|
| S | 49 | | | | | | | 21 | | 28 | | | | | | | | | |
| | 11 | | | | | 5 | 6 | | | | | | | | | | | | |
| | 24 | | 5 | 4 | 3 | 2 | 2 | 7 | | | | | | | | | | | |
| Tr1 | 38 | | | | | | | 16 | | 22 | | | | | | | | | |
| | 22 | | | | 5 | 5 | 12 | | | | | | | | | | | | |
| | 24 | | 3 | | 7 | 4 | 5 | 5 | | | | | | | | | | | |
| Ro1 | 41 | | | | | | | 21 | | 20 | | | | | | | | | |
| | 19 | | | | | 5 | 14 | | | | | | | | | | | | |
| | 24 | | | 3 | 5 | 5 | 3 | 5 | | 3 | | | | | | | | | |
| Ro2 | 46 | | | | | | | 16 | | 22 | | 8 | | | | | | | |
| | 14 | | | | | | 5 | | 9 | | | | | | | | | | |
| | 24 | | | | 3 | 3 | 3 | 6 | 3 | 6 | | | | | | | | | |
| Tr2 | 43 | | | | | | | | | 29 | | 14 | | | | | | | |
| | 17 | | | | | 3 | | | 14 | | | | | | | | | | |
| | 24 | | | | | 8 | | | 8 | 8 | | | | | | | | | |
| Bu1 | 47 | | | | | | | | | 26 | | 17 | | 4 | | | | | |
| | 13 | | | | | | 7 | | 6 | | | | | | | | | | |
| | 24 | | | | | 3 | 5 | | 4 | 7 | | 5 | | | | | | | |
| Fa1 | 57 | | | | | | | | | 26 | | 24 | | 7 | | | | | |
| | 3 | | | | | | | | 3 | | | | | | | | | | |
| | 24 | | | | | 4 | 4 | | 4 | 7 | | 5 | | | | | | | |
| Tr3 | 34 | | | | | | | | | | | 27 | | 7 | | | | | |
| | 26 | 3 | | | | | | | 12 | | 11 | | | | | | | | |
| | 24 | 6 | | | | | | | 3 | | 9 | 6 | | | | | | | |
| Fa2 | 54 | | | | | | | | | | | 26 | | 28 | | | | | |
| | 6 | | | | | | | | | | 6 | | | | | | | | |
| | 24 | 6 | | | | | | | 4 | | 4 | 10 | | | | | | | |
| Bu2 | 35 | | | | | | | | | | | | | 21 | 14 | | | | |
| | 25 | 16 | | | | | | | | | | | 9 | | | | | | |
| | 24 | 9 | | | | | | | | | 5 | | | 10 | | | | | |
| Fa3 | 54 | | | | | | | | | | | | | 31 | 19 | 4 | | | |
| | 6 | 2 | | | | | | | | | | | 4 | | | | | | |
| | 24 | 6 | | | | | | | | | | | 6 | 12 | | | | | |
| Bu3 | 45 | | | | | | | | | | | | | | 14 | 12 | 9 | 6 | 4 |
| | 15 | 6 | | | | | | | | | | | 9 | | | | | | |
| | 24 | 6 | | | | | | | | | | | 9 | | 9 | | | | |
| Fa4 | 54 | | | | | | | | | | | | | | 14 | 17 | 19 | 3 | 1 |
| | 6 | | | | | | | | | | | | 6 | | | | | | |
| | 24 | 8 | | | | | | | | | | | 7 | | 5 | 4 | | | |

FIG. 6

GOLF SIMULATION GAME APPARATUS

FIELD OF THE INVENTION

The present invention relates to a board game. More particularly, the present invention relates to a board game for simulating the play of golf.

BACKGROUND OF THE INVENTION

A number of games that attempt to simulate the play of golf have been devised. In these golf simulation games, advancement of a golf ball is typically determined by activating a chance means, such as, for example, a plurality of dice. Some of these simulation games further require that the player consult accompanying charts in order to determine the outcome of a simulated golf shot.

For example, U.S. Pat. No. 6,047,967 to Murphy et al., discloses a golf simulation game wherein advancement of a golf ball is determined by simply activating a chance means. Different dice are employed to determine the outcomes for the first, second, third, and fourth shots of each hole and also for putting.

U.S. Pat. No. 5,470,077, to Brewster et al., and U.S. Pat. No. 5,234,218 to LaRocca, each disclose golf simulation games wherein advancement of a golf ball is determined by activating a chance means and consulting an accompanying chart.

Another example, U.S. Pat. No. 5,000,460 to Barbiaux et al., also discloses a golf simulation game wherein advancement of a golf ball is determined by activating a chance means. In this game, the distance of a simulated golf shot is determined by rolling a set of dice and consulting a chart, and the direction of a simulated golf shot is determined by rolling a single die and consulting a direction indicating gauge.

It therefore remains desirable to make a more entertaining golf simulation board game wherein the outcome of a simulated shot is not determined simply through the activation of a chance means.

In addition, it is desirable to make a golf simulation board game that is capable of reproducing topographical situations commonly encountered on a golf course and that requires a player to determine the amount of risk that the player may be willing to assume in executing each simulated golf shot.

It is also desirable to produce a golf simulation board game that introduces. strategic decisions that, in addition to the activation of a chance means, affect the outcome of a simulated golf shot.

SUMMARY OF THE INVENTION

The present invention provides an improved golf simulation board game wherein the outcome of a simulated shot is not determined solely through the activation of a chance means.

The present invention also provides an improved golf simulation board game that reproduces the various topographic situations commonly encountered on a golf course and that requires a player to determine the amount of risk that the player may be willing to assume in executing each simulated golf shot.

The present invention further provides an improved golf simulation board game that introduces strategic decisions that, in addition to the activation of a chance means, affect the outcome of a simulated golf shot.

In accordance with one aspect of the present invention, a golf simulation game comprises a set of hole cards. Each hole card depicts a topographical layout of an individual hole, and each hole card has a plurality of different result zones. Each result zone corresponds to a possible outcome that corresponds to a simulated golf ball location after a player's simulated golf shot. The game also includes a set of stroke cards. Each stroke card-corresponds to a particular result zone of an individual hole and has a plurality of different sets of outcomes for any given simulated golf shot. A chance means is provided for determining which outcome of the plurality of different sets of outcomes is obtained after the player's simulated golf shot.

In accordance with another aspect of the present invention, a method of playing a golf simulation game comprises a step of providing a set of hole cards. Each hole card depicts a topographical layout of an individual hole and each hole card has a plurality of different result zones. Each result zone corresponds to a possible outcome corresponding to a simulated golf ball location after a player's simulated golf shot. The method further includes steps of: providing a set of stroke cards, each stroke card corresponding to a particular result zone of an individual hole and having a plurality of different sets of outcomes for any given simulated golf shot; providing chance means to generate a numerical value; setting up the simulated golf shot by selecting a result line defining one of the plurality of different sets of outcomes from the stroke card that corresponds to the player's current golf ball location; and executing the simulated golf shot by activating a chance means in order to generate a numerical value corresponding to one of the outcomes from the selected result line.

In accordance with yet another aspect of the present invention, a method of playing a golf simulation game comprises the steps of: providing a set of hole cards, each hole card depicting a topographical layout of an individual hole and each hole card having a plurality of different result zones, each result zone corresponding to a possible outcome corresponding to a simulated golf ball location after a player's simulated golf shot; providing a set of stroke cards, each stroke card corresponding to a particular result zone of an individual hole and having a plurality of different sets of outcomes for any given simulated golf shot; providing chance means to generate a numerical value; setting up the simulated golf shot by selecting both a numerical range and a result line defining one of the plurality of different sets of outcomes from the stroke card that corresponds to the player's current golf ball location; and executing the simulated golf shot by activating a chance means up to four times in order to generate a numerical value within the selected numerical range

BRIEF DESCRIPTION OF THE DRAWINGS

These and other features, aspects, and advantages of the present invention will become better understood with regard to the following description, appended claims, and accompanying drawings where:

FIGS. 2A and 2B show a complete set of stroke cards for play through the golf course for the hole depicted in FIG. 1;

FIG. 3 shows a complete set of stroke cards for play on the green for the hole depicted in FIG. 1;

FIG. 4 shows a single stroke card for play through the golf course, and illustrates the dice line, the result lines, the stroke line, the correction area, and the impact area of the stroke card.

FIG. 6 shows a chart that is used to assist in preparing the stroke cards of the invention.

DESCRIPTION OF THE INVENTION

Figure 1:
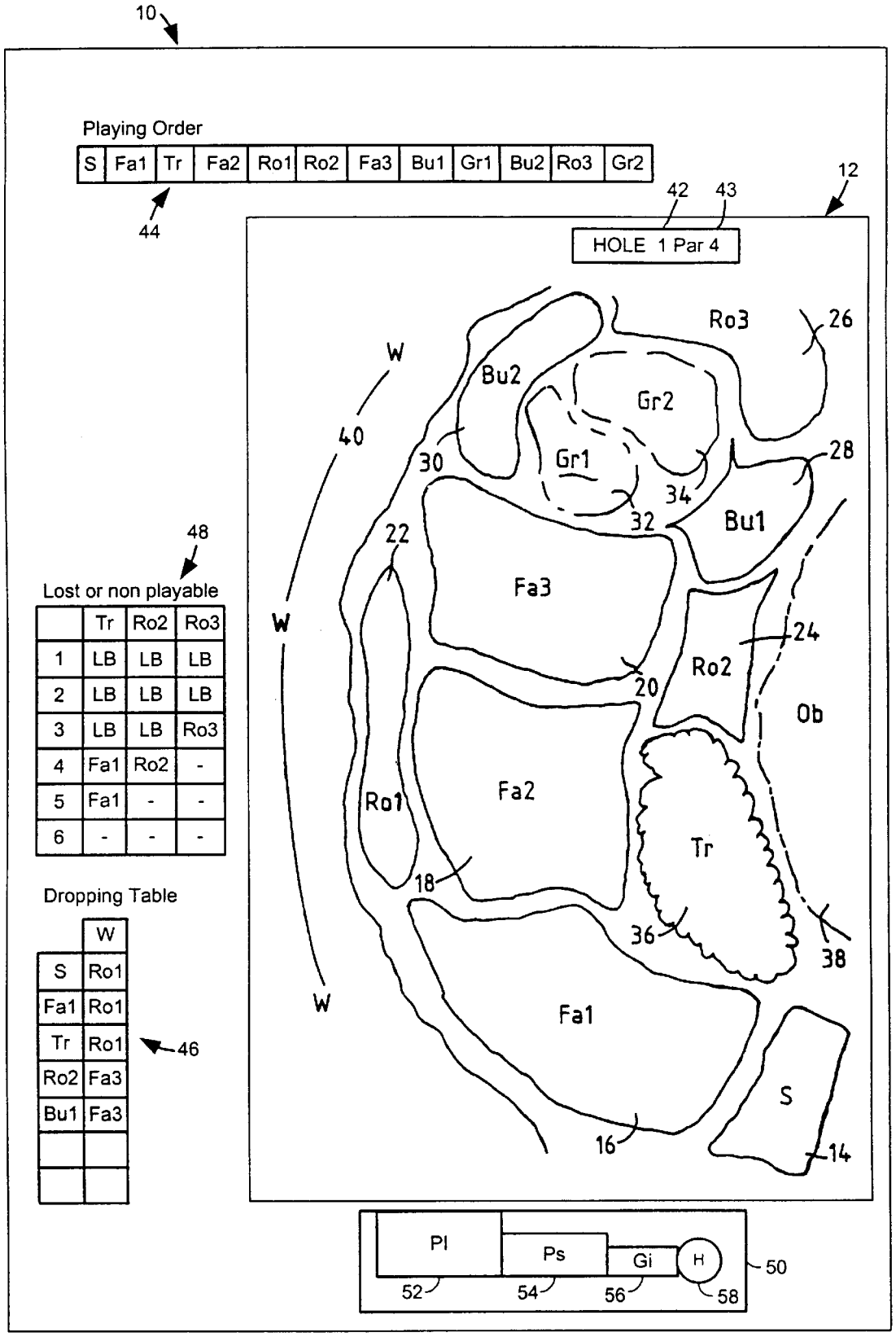
FIG. 1 shows a hole card identifying an individual hole by number and providing par score for the hole, and including a playing order table, a dropping table, a lost or unplayable ball table, a through the golf course board depicting the layout of the individual golf hole, and a green board depicting the layout of the putting green of the individual golf hole.

In FIG. 1, a hole card 10 of the golf simulation game apparatus of the present invention is shown. A through the golf course board 12 of hole card 10 illustrates a number of different result zones such as a tee area 14, a first fairway area 16, a second fairway area 18, a third fairway area 20, a first rough area 22, a second rough area 24, a third rough area 26, a first bunker 28, a second bunker 30, a first green area 32, a second green area 34, a tree area 36, an out of bounds area 38, and a water hazard 40.

Each of the golf holes depicted on a through the course board, such as, for example, through the course board 12, of a hole card 10 may have one or more fairway areas. If there are multiple fairway areas, the first fairway area, such as, for example, first fairway area 16, is generally located adjacent to the tee area, such as, for example, tee area 14. Similarly, the second fairway area, such as, for example, second fairway area 18 is generally adjacent to the first fairway area 16, and the third fairway area, such as, for example, third fairway area 20 is generally adjacent to the second fairway area 18. Each of the through the course boards, such as, for example, through the course board 12, may further include multiple obstruction areas such as one or more rough areas, such as the first rough area 22, one or more bunkers, such as the first bunker 28, one or more tree areas, such as the tree area 36, one or more water hazards, such as the water hazard 40, and one or more out of bounds areas, such as the out of bounds area 38.

The hole card 10 identifies the specific golf hole by number 42 and also indicates the par score 43 for that specific hole. The hole card 10 further includes a playing order table 44 for determining the order of play after each player has executed at least one shot, a dropping table 46 for determining a final outcome of a shot having an initial outcome that is designated to be in a water hazard, such as, for example, water hazard 40, a lost or non-playable ball table 48 for ascertaining a final outcome of a shot having an initial outcome that is designated to be lost or unplayable, and a green board 50. The green board 50 of hole card 10 has multiple result zones, such as a long putt area 52, a short putt area 54, a ball given area 56, and a hole area 58 for a shot made in the hole.

FIGS. 2A and 2B depict a set of stroke cards 60 for determining the outcome of shots made during simulated play through the course with respect to the hole depicted on the hole card 10 illustrated in FIG. 1. For each result zone of the through the course board 12 shown in FIG. 1, there is a corresponding stroke card. For example, with respect to the golf hole depicted on the through the course board 12, stroke card 62 is used for determining the outcome of a shot made from the tee area 14, and stroke card 64 is used for determining the outcome of a shot made from the first fairway 16.

FIG. 3 shows a set of stroke cards 65 for determining the outcome of shots made during simulated play on the green with respect to the hole depicted on the hole card 10 of FIG. 1. For example, stroke card 66 is used in order to determine the outcome of a putt made from the first green area 32, and stroke card 68 is used for determining the outcome of a putt made from the second green area 34. The set of stroke cards for play on the green may also include stroke cards for simulating putts made from the long putt area 52, such as, for example, stroke card 67, and for putts made from the short putt area 54, such as, for example, stroke card 69. Each stroke card for play on the green, such as, for example, stroke card 66, has three result lines, a first green result line 94, a second green result line 96, and a third green result line 98. Each green result line has its own set of possible simulated golf shot outcomes.

FIG. 4 illustrates a stroke card 70 that is used to determine the outcome of shots made from the first bunker 28. A dice line 72 corresponds to a numerical value generated by activating a chance means 88 (depicted in FIG. 5). The stroke card 70 has four result lines, a first result line 74, a second result line 76, a third result line 78, and a fourth result line 80. Each result line has its own set of possible simulated golf shot outcomes. A stroke column 82 divides the stroke card 70 into an impact area 84 and a correction area 86. The five columns to the right of the stroke column 82 represent the impact area 84 of the stroke card 70 and the six columns to the left of the stroke column 82 represent the correction area 86 of the stroke card 70.

Figure 5:
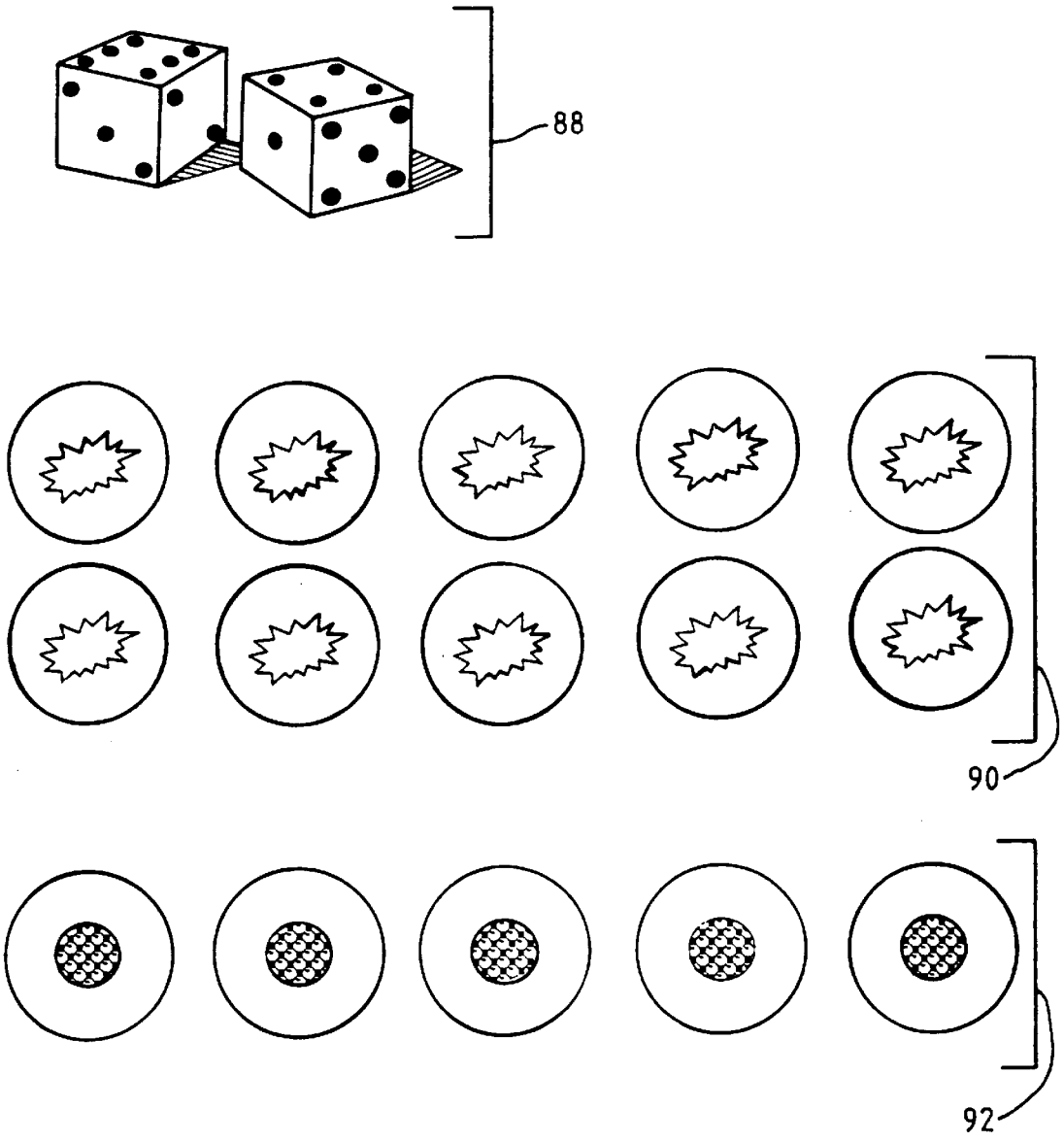
FIG. 5 shows a chance means, a set of divot counters, and a set of ball counters.

FIG. 5 shows a set of dice 88 which can be employed as a chance means in accordance with the present invention, a set of divot counters 90 for counting the number of strokes a player makes with respect to an individual hole, and a set of ball markers 92 for marking the location of a golf ball during simulated play.

According to one aspect of the present invention, the game is played using cards, counters, and a chance means, such as, for example, a pair of dice 88. The elements may be physical cards, counters, and dice or may be computer representations of the same in which case a computer program is used to input player commands, to determine the outcome of a simulated golf shot in part by using a random number generator as a chance means, and to display the various actions of the cards as the game progresses. The golf course cards of the present invention can simulate real or imaginary golf courses, and the game allows for any amount of different courses.

More specifically, the equipment for playing the game comprises a set of divot counters 90, up to 15 for each player with one color for each player, used to keep count of the number of strokes each player makes in each hole played, a set of ball markers 92 (one marker for each player), a chance means, typically comprising a set of dice 88, a double set of stroke cards (one set for simulated play through the course and a second set for simulated play on the green), generally including between nine and sixteen stroke cards for each hole, and a set of hole cards, one for each hole in the course. Each hole card also includes a through the course board that generally includes at least the following result zones, which are preferably color-coded as indicated:

S=Tee area (blue)
Fa=Fairway area(green)
Ro=Rough area (orange)
Tr=Tree area (lilac)
Bu=Bunker (yellow)
W=Water hazard (light blue)
Ob=Out of bounds area (brown)
Gr=Green area (light green)

Each hole card further includes a green board generally having at least the following result zones:

PI=Putt long area

Ps=Putt short area

Gi=Ball given area

H=Hole

Play of the game is generally initiated from a tee area, such as, for example, tee area 14. In accordance with one aspect of the present invention, a player must first select a result line, such as, for example 74, 76, 78, or 80 prior to executing a simulated golf shot. Preferably, this choice is made known to the other players. Subsequent to this choice, the player activates a chance means, such as, for example, a set of dice 88, and the outcome of the simulated golf shot is then determined by consulting the selected result line of the stroke card that corresponds to the area from which the shot is made.

For example, a player chooses a first result line, such as, for example, first result line 74. After preferably making the result line selection known to the other players, the player activates a chance means, such as, for example, a set of dice 88, generating a six and a five. The outcome of the player's simulated golf shot can be determined by consulting the selected result line of the stroke card corresponding to the area from which the shot is made. Thus, if the shot is made from tee area 14, stroke card 62 is consulted to determine the outcome of the simulated golf shot. The outcome of the player's simulated golf shot is indicated in the column corresponding to eleven (the sum of the numbers generated by the chance means) of the first result line 74 because the player selected the first result line. In this example, the outcome of the player's simulated golf shot from the tee area 14 of the hole depicted on hole card 10 is the third fairway area 20. Play is continued in a similar manner until each player finishes the hole.

A player's selection of a result line is very important. In effect, the result line selection sets the shot up by defining the set of possible simulated golf shot outcomes. Furthermore, the result line selection reflects a player's willingness to assume varying degrees of risk when executing a simulated golf shot.

Generally, the first result line, such as, for example, first result line 74 of stroke card 70 includes the greatest number of the most favorable simulated golf shot outcomes with respect to the set of result lines on the stroke card. For example, on stroke card 70 the most favorable outcome that a player can obtain corresponds to a shot hit to the third fairway. This outcome occurs three times in the first result line 74 but only occurs once in the fourth result line 80. However, the first result line, such as, for example, first result line 74, also typically includes the greatest number of the most unfavorable simulated golf shot outcomes with respect to the set of result lines. On stroke card 62, the most unfavorable outcome that a player can receive corresponds to a shot that was hit out of bounds. This outcome occurs twice on the first result line 74 but not at all on the fourth result line 80. Thus, the selection of the first result line, such as, for example, first result line 74 of stroke card 62, will generally correspond to an aggressive simulated golf shot selection.

According to one. aspect of the invention, the golf simulation board game also allows for players to pursue less aggressive play. For example, a player may select the fourth result line, such as, for example, fourth result line 80 of stroke card 62. As previously explained, the set of outcomes contained in the fourth result line 80 does not include as many favorable simulated golf shot outcomes as does the set of outcomes contained in the first result line 74. However, the set of possible simulated golf shot outcomes in the fourth result line 80 also contains fewer unfavorable simulated golf shot outcomes than the first result line 74. Thus, a player must assess the amount of risk that the player is willing to assume when executing a simulated golf shot, and select a result line commensurate with the player's willingness to assume risk.

In accordance with another aspect of the present invention, a player must first select both a numerical range and a result line 74, 76, 78, or 80 prior to executing a simulated golf shot. Preferably, these choices are made known to the other players. The preferred numerical ranges available for selection are typically 8–9, and 10–12. Note that these numbers correspond to the impact area 84 of a stroke card, such as, for example, stroke card 70. Subsequent to the player's choices of a numerical range and a result line, the player activates a chance means, such as, for example, a set of dice 88.

According to this aspect of the present invention, the player activates the chance means up to four times in order to obtain one of the numbers within the selected numerical range of the impact area. For example, a player selects the first result line, such as, for example the first result line 74 of stroke card 70 (FIG. 4) and the numerical range of 8–9. If the player generates the sum of eight on the first activation of the chance means, the player would obtain the outcome indicated in the column corresponding to eight of the first result line 74. If the player generates the sum of nine on the first activation of the chance means, the player would obtain the outcome indicated in the column corresponding to nine of the first result line 74. If the player does not generate a sum equaling eight or nine on the first activation of the chance means, no simulated golf shot outcome is obtained on the first activation of the chance means. The player must then activate the chance means at least one additional time in order to obtain a simulated golf shot outcome. If the player generates a number within the selected range on the second activation of the chance means, the player obtains the outcome indicated in the column corresponding to the generated number of the second result line 76, despite the player's selection of a first result line 74. However, if the player fails to obtain a sum within the selected numerical range on the second activation of the chance means, the player must activate the chance means at least one more time. If the player generates a number within the selected range on the third activation of the chance means, the player obtains the outcome indicated in the column corresponding to the generated number of the third result line 78. However, if the player fails to generate a number within the selected numerical range on the third activation of the chance means, the player must activate the chance means a fourth and final time. If the player generates a number within the selected numerical range on the fourth activation of the chance means, the player obtains the outcome indicated in the column corresponding to the generated number of the fourth result line 80. However, if the player does not obtain a number within the selected numerical range on the fourth activation of the chance means, the player must make a corrective throw.

A corrective throw is made by activating a chance means capable of generating a number between 1 and 6, such as, for example, a single die. The player then obtains the outcome corresponding to the number obtained from activating the chance means in the correction area 86 of the result line initially selected by the player.

Accordingly, a player must assess the amount of risk inherent in making a simulated golf shot when playing according to this aspect of the present invention. In selecting the first result line 74, the player may obtain a very positive outcome that may not be attainable by selecting one of other result lines. However, when a player does not obtain a value within the selected numerical range in the first four activations of the chance means, the player obtains an outcome within the corrective area 86 of the selected result line. Generally, those result lines having very positive simulated shot outcomes also include very poor shot simulated shot outcomes. Thus, when a player pursues an aggressive shot selection by selecting the first result line 74, the player has a chance to make very positive shots. However, if the player does not attain a number within the selected numerical range on the first four activations of a chance means, the result line selection defines the set of outcomes, which may include several poor outcomes, for the corrective throw.

For example, when a player activates a chance means such as, for example, a set of six sided dice 88, and selects the numerical range of 8–9, for each activation of the chance means, there is a one in four chance that the player will obtain a value within the selected numerical range, and thus obtain a value in the impact area 84. However, there is also a considerable chance (eighty one out of two hundred fifty six) that the player will not obtain a value within the selected numerical range of 8–9 after activating the chance means four times. According to this aspect of the present invention, if a player does not obtain a value within the selected numerical range after activating the chance means four times, the player will necessarily receive an outcome from the corrective area 86 of the stroke card.

Accordingly, the player must evaluate the risks associated with a particular result line, and make the result line selection based upon the player's willingness to assume the risks associated with the particular result line.

Furthermore, in accordance with this aspect of the invention, if a player selects the second result line 76, the first two activations of the chance means correspond to those outcomes defined by the second result line 76 while the third activation of the chance means corresponds to those outcomes defined by the third result line 78, and the fourth activation of the chance means corresponds to those outcomes defined by the fourth result line 80. Similarly, if the player selects the third result line 78, the first three activations of the chance means correspond to those outcomes defined by the third result line 78, and the fourth activation of the chance means corresponds to the outcomes defined by the fourth result line 80. Finally, if the player selects the fourth result line 80, all four activations of the chance means correspond to those outcomes defined by the fourth result line 80.

In accordance with this aspect of the present invention, the selection of a result line 74,76,78 or 80 defines the possible outcomes for a corrective throw. Corrective throws must be made when the player does not obtain a value within the selected numerical range in the first four activations of the chance means. Again, the player's selection of a result line influences the possible simulated. shot outcomes, and reflects the player's willingness to assume a degree of risk in the player's shot selection.

When the player's golf ball is located on the green, such as, for example, the first green area 32, the second green area 34, the long putt area 52, or the short putt area 54 (FIG. 1), the method of play is different. The player must choose one of three possible green result lines, such as, for example, green result lines 94, 96, or 98 from the stroke card corresponding to the player's location on the green, such as, for example stroke card 66 shown in FIG. 3. Preferably, the player makes this choice of green result line 94, 96, or 98 known to the other players. When making a putt on the green, the player activates a chance means capable of generating a number from one to six, such as, for example, a single six sided die. After generating a number from one to six, the player obtains a simulated golf shot outcome that corresponds to the generated number in the selected green result line 94, 96, or 98.

Once a simulated golf shot outcome is obtained, and as long as this outcome is not a special outcome (water hazard, out of bounds, a rough area marked with an asterisk, or a tree area marked with an asterisk), the player marks the executed stroke with a divot counter 90 in the zone where the ball was and moves a ball counter 92 to the result zone corresponding to the obtained simulated shot outcome.

If a special outcome is obtained, the method of play is different. If the simulated golf shot outcome is a missed stroke, a shank, a socket or an air ball, then the simulated shot outcome is the result zone where the ball was originally located, and the divot counter 90 and the ball marker 92 remain in their original positions. If the simulated golf shot outcome is a water hazard, the first divot counter remains in its original position, a second divot counter is placed in the water hazard, and the ball marker is placed in the zone indicated by the dropping table 46 (FIG. 1). The first column of the dropping table 46 corresponds to the zone from which the player made the shot, and the second column indicates the zone where the ball marker 92 must be placed. If the simulated golf shot outcome is out of bounds, the divot counter 90 and the ball marker 92 remain in their original positions, and an additional divot counter 90 is placed in the out of bounds zone. If the simulated golf shot outcome is a rough area marked with an asterisk or a tree area marked with an asterisk, the player must complete the stroke by activating a chance means capable of generating a number from one to six, such as, for example, a single die, in order to obtain the complement of the result from the lost or non playable ball table 48 (FIG. 1). After generating a number from one to six, the complement of the result is obtained from the intersection of the row of the generated number and the column corresponding to the zone of the original result. If the obtained complement of the result is a lost ball, the divot counter 90 and the ball marker 92 remain in their original positions. If the obtained complement of the result is a new zone or is the same zone from which the simulated golf shot was made, the divot counter 90 remains in its original position, a second divot counter 90 is placed in the obtained result zone, and a ball marker 92 is placed in the complement of the result zone. If the obtained complement of the result is (–), there is no penalty, the divot counter 90 remains where it was, and the ball marker 92 is placed in the original simulated golf shot outcome. If the result of the stroke is ball given, the divot counter 90 remains in its original position, a second divot counter 90 is placed in the given zone, and the ball marker 92 is placed in the hole 58.

After executing a tee shot, the playing order is obtained from the table on hole card 10. When two players obtain simulated shot outcomes in the same zone, the one arriving in the zone first plays first. If a player obtains an outcome that leaves him in the same zone, and another player is also in this same zone, the first player must allow the other player to proceed before making a second shot from that zone.

A method of designing the hole and stroke cards in accordance. with the present invention is also provided. The method comprises the following steps:

1. A drawing is prepared from a hole of an actual or imaginary golf course. The hole is divided into various zones that reflect the topographical layout of the hole.

A drawing can also be prepared in a similar fashion for a golf hole designed for use in the game according to the invention. This drawing is the hole card, and will also be used to create the set of stroke cards in accordance with the invention.

2. A chart is prepared, a sample of which is depicted in FIG. 6. In the rows of this chart the various through the course result zones are ordered, not necessarily by distance from the green, but instead according to the difficulty of approach shots from that zone to the green. In preparing the chart, the water hazard(s), the out of bounds area(s), and the green area(s) are not included as they are formed in a different way. The possible outcomes, including greens, putts, given and hole, are placed in the columns of the chart. The outcomes are also ordered according to the difficulty of the approach shots to the green from the zone corresponding to the outcome.

Each row has three lines:

2.1 The top line (blue) corresponds to the results of a good stroke, obtained in the impact area of the card.

2.2 The intermediate line (brown) corresponds to a regular or bad stroke, obtained in the impact area of the card.

2.3 The bottom line (green) corresponds to results obtained in the correction area.

3. When creating the stroke cards the following factors should be considered:

3.1 The distance that can be reached from a given zone. For example, with respect to the through the course board 12 of hole card 10 shown in FIG. 1, the stroke card 62 (FIG. 2A) for determining the outcome of a shot made from the tee area 14 indicates that the maximum distance attainable from the tee area is the third fairway;

and stroke card 64 indicates that the maximum distance attainable from the first fairway is the third fairway.

3.2 The zones that may be reached from the zone in which the shot is made. For example, a stroke from the second rough cannot reach the first rough.

3.3 The probability indicating numbers given to each possible result are obtained and distributed as follows:

4. The following chart lists the probabilities of generating a sum that is equal to the numbers listed in the impact area of a stroke card upon activating a chance means, such as a set of dice. The simple probability of obtaining a number in the impact area is assigned to be 5/36 to 1/36. In the correction area of a stroke card, the probability of obtaining a number is always 1/6.

| 7/6 | 5 | 4 | 3 | 2 | 1 | L | 8 | 9 | 10 | 11 | 12 |
|---|---|---|---|---|---|---|---|---|---|---|---|
| 1 | 1 | 1 | 1 | 1 | 1 | 1 | 5 | 4 | 3 | 2 | 1 |
| 1 | 1 | 1 | 1 | 1 | 1 | 2 | 5 | 4 | 3 | 2 | 1 |
| 1 | 1 | 1 | 1 | 1 | 1 | 3 | 5 | 4 | 3 | 2 | 1 |
| 1 | 1 | 1 | 1 | 1 | 1 | 4 | 5 | 4 | 3 | 2 | 1 |

As a result of this assignment of probability indicating numbers, there are 60 points which are reflected in the top and intermediate lines for each impact area. The designer can assign these points in a discretionary fashion. When larger amounts of points are distributed in the top line, there are lesser amount of points to distribute in the intermediate line. This necessarily means that the stroke will be easier because more positive outcomes will be included. There are also twenty four points to distribute from the correction area in the bottom line. For example, with respect to a stroke card for determining the outcome of a shot made from a tee area, the following factors also reflect the game designer's discretion in designing the stroke cards.

a) The maximum distance attainable by a shot from the tee is the second fairway.

b) The possible outcomes of a shot made from the tee area are the first tree area, the first rough, the second rough, the second tree area, the first bunker, the first fairway, and the second fairway.

c) The designer defines good simulated shot outcomes to be the first fairway and the second fairway. These good simulated shot outcomes are consistent with the real game of golf where a good stroke goes in the fairway.

d) The designer defines as a regular or bad simulated shot outcomes to be the second tree area and the first bunker (which represents a good advance but the ball is located in a hazard zone).

e) The designer defines the results of a bad corrective stroke to be the first tree area, the first rough, and the second rough. The designer defines the possible simulated golf shot outcomes of a bad but with advance corrective stroke to be the second tree area and the first bunker. Finally, the designer defines the possible simulated golf shot outcomes of a bad but with luck corrective stroke to be the first fairway.

f) Finally, the designer distributes the possible simulated golf shot outcomes on a stroke card and controls the sums of the probability indicating numbers so that each zone has the desired degree of difficulty. By this it is meant that if a designer distributes a result in a column corresponding to the sum of eight, five points are distributed.

5. When creating a green card, the possible simulated shot outcomes are distributed so that the probability of remaining far from the hole is greater for a risky stroke, such as, for example, a long putt, than for a conservative stroke.

Although the present invention has been described in considerable detail with reference to certain preferred versions thereof, other versions are possible. Therefore, the spirit and scope of the appended claims should not be limited to the description of the preferred versions contained herein.

What is claimed is:

1. A golf simulation game apparatus comprising:

(a) a set of hole cards, each hole card depicting a topographical layout of an individual golf hole, each hole card having a plurality of different result zones, and each result zone corresponding to a possible outcome corresponding to a simulated golf ball location after a player's simulated golf shot;

(b) a set of stroke cards, each stroke card corresponding to a particular result zone of an individual golf hole and having a plurality of different sets of outcomes, wherein each set of outcomes varies in relation to an amount of risk the player may wish to assume in executing any given simulated golf shot; and (c) chance means for determining which outcome of the plurality of different sets of outcomes is obtained after the player's simulated golf shot.

2. The golf simulation game apparatus of claim 1 wherein at least one hole card includes a green board having a plurality of different result zones, each result zone corresponding to a possible outcome corresponding to a simulated golf ball location after the player's simulated golf shot.

3. The golf simulation game apparatus of claim 1 wherein at least one hole card includes a lost or non-playable ball table for determining a final outcome of a simulated golf shot having an initial outcome that is designated to be either lost or non-playable ball.

4. The golf simulation game apparatus of claim 1 wherein at least one hole card includes a dropping table for determining a final outcome of a simulated golf shot having an initial outcome that is designated to be in a water hazard.

5. The golf simulation game apparatus of claim 1 wherein the set of stroke cards for each individual hole comprises a set of stroke cards for simulating play through a golf course other than on the green, and a separate card for simulating play on the green.

6. The golf simulation game apparatus of claim 1 wherein each hole card has at least nine result zones.

7. The golf simulation game apparatus of claim 1 comprising at least eighteen hole cards.

8. The golf simulation game apparatus of claim 1 wherein the set of stroke cards comprises a plurality of result lines, each result line having a different set of outcomes for any given simulated golf shot.

9. The golf simulation game apparatus of claim 1 wherein the chance means comprises a set of dice.

10. A method of playing a golf simulation game, the method comprising the steps of:

(a) providing a set of hole cards, each hole card depicting a topographical layout of an individual golf hole, and each hole card having a plurality of different result zones, each result zone corresponding to a possible outcome corresponding to a simulated golf ball location after a player's simulated golf shot;

(b) providing a set of stroke cards, each stroke card corresponding to a particular result zone of an individual golf hole and having a plurality of different sets of outcomes, wherein each set of outcomes varies in relation to an amount of risk the player may wish to assume in executing any given simulated golf shot;

(c) providing chance means to generate a numerical value;

(d) setting up the simulated golf shot by selecting a result line which is commensurate with the amount of risk the player wishes to assume in executing the simulated golf shot, thereby defining one of the plurality of different sets of outcomes from the stroke card that corresponds to the player's current golf ball location as the only set of outcomes that can be obtained as a result of the simulated golf shot;

(e) executing the simulated golf shot by activating the chance means in order to generate a numerical value corresponding to one of the outcomes from the selected result line.

11. The method of playing a golf simulation game according to claim 10, further comprising the step of:

(f) moving a ball marker to the result zone that corresponds to the selected result line and the numerical value obtained through activation of the chance means.

12. The method of playing a golf simulation game according to claim 10, wherein step (d) further comprises making the result line selection known to the other players.

13. A method of playing a golf simulation game, the method comprising the steps of:

(a) providing a set of hole cards, each hole card depicting a topographical layout of an individual hole and each hole card having a plurality of different result zones, each result zone corresponding to a possible outcome corresponding to a simulated golf ball location after a player's simulated golf shot;

(b) providing a set of stroke cards, each stroke card corresponding to a particular result zone of an individual hole and having a plurality of different sets of outcomes, wherein each set of outcomes varies in relation to an amount of risk the player may wish to assume in executing any given simulated golf shot;

(c) providing chance means to generate a numerical value;

(d) setting up the simulated golf shot by selecting both a numerical range and a result line which are commensurate with the amount of risk the player wishes to assume in executing the simulated golf shot, thereby defining one of the plurality of different sets of outcomes from the stroke card that corresponds to the player's current golf ball location as the only set of outcomes that can be obtained as a result of the simulated golf shot; and (e) executing the simulated golf shot by activating a chance means up to four times in order to generate a numerical value within the selected numerical range.

14. The method of playing a golf simulation game according to claim 13, further comprising the step of:

(f) moving a ball marker to the result zone that corresponds to the selected result line and the obtained numerical value if a numerical value within the selected numerical range is obtained in the first activation of the chance means.

15. The method of playing a golf simulation game according to claim 13, wherein step (d) further comprises making the result line and numerical range selections known to the other players.

* * * * *